US005298009A

United States Patent [19]

Long

[11] Patent Number: 5,298,009

[45] Date of Patent: Mar. 29, 1994

[54] LETTER SHEET FORMING APPARATUS AND METHOD

[76] Inventor: John A. Long, 41 Lamont Avenue, Scarborough, Ontario, M1S 1A8, Canada

[21] Appl. No.: 101,090

[22] Filed: Aug. 3, 1993

Related U.S. Application Data

[63] Continuation of Ser. No. 859,879, Mar. 30, 1992, abandoned, which is a continuation-in-part of Ser. No. 816,712, Jan. 3, 1992, Pat. No. 5,275,857, which is a continuation-in-part of Ser. No. 800,288, Nov. 29, 1991, Pat. No. 5,228,657.

[51] Int. Cl.[5] ..... B65H 35/10; B65H 45/22; B65H 45/28

[52] U.S. Cl. ..... 493/342; 493/357; 493/362; 493/363

[58] Field of Search ..... 493/357, 358, 361-365, 493/369, 438-440, 441, 443, 446, 455, 72, 81, 233, 234, 235, 342

[56] References Cited

U.S. PATENT DOCUMENTS

| | | | |
|---|---|---|---|
| 2,009,857 | 7/1935 | Potdevin . | |
| 2,090,308 | 8/1937 | Potdevin | 493/235 |
| 2,124,209 | 7/1938 | Poppe | 493/233 |
| 2,212,469 | 8/1940 | French | 493/235 |
| 3,735,975 | 5/1973 | Sukel | 493/11 |
| 3,900,159 | 8/1975 | Gendron . | |
| 3,902,655 | 9/1975 | Huffman . | |
| 4,022,457 | 5/1977 | Marin | 493/438 |
| 4,050,361 | 9/1977 | Traise . | |
| 4,378,223 | 3/1983 | Branecky et al. . | |
| 4,533,130 | 8/1985 | Suter | 493/342 |
| 5,104,366 | 4/1992 | Bunch | 493/23 |

*Primary Examiner*—Jack Lavinder

[57] ABSTRACT

A machine for forming letter sheets from a paper web having regularly spaced transverse cut lines extending inwardly from pin hole edges and leaving a perforated but uncut middle portion has a tractor feed, a slitter for removing the pin hole edges of the web, an in-line Z-folder, pinch rollers and a burster. The Z-folder has a length which is one and half to two times the spacing between transverse perforation lines. The speed of the tractor feed drive and pinch roller drive are monitored and a sensor senses each transverse cut so that the speed of the pinch rollers may be synchronised with the tractor feed.

10 Claims, 5 Drawing Sheets

LETTER SHEET FORMING APPARATUS AND METHOD

CROSS-REFERENCE TO RELATED APPLICATION

This application is a continuation of application Ser. No. 07/859,879, filed Mar. 30, 1992 now abandoned which is a continuation-in-part of application Ser. No. 816,712, filed Jan. 3, 1992 now U.S. Pat. No. 5,275,857 which is a continuation-in-part of application Ser. No. 800,388 filed Nov. 29, 1991 now U.S. Pat. No. 5,228,657.

BACKGROUND OF THE INVENTION

1. Field of the Invention

This invention relates to a method and an apparatus for forming letter sheets.

2. Description of the Related Art

Mass mailings generally rely upon apparatus to feed, cut and fold a continuous form into folded letter sheets for stuffing in an envelope. The continuous form is typically provided in a paper web having pin hole edges for tractor feeding of the web. Furthermore, the web may be perforated across its width at uniform intervals; in such case, the paper web is often referred to as "computer paper". One method of handling a paper web (with or without the noted transverse perforations) is as follows. The paper web is tractor fed to a separating station (if the web is transversely perforated) or a cutting station (if the web is not transversely perforated) and the separate sheets are then conveyed to a folding station whereat automatic arms first fold one marginal portion of the sheet over a medial portion of the sheet and then fold the remaining marginal portion of the sheet over the first mentioned marginal portion and the medial portion of the sheet. This results in a folded letter which has a standard letter fold. One drawback with this method is that once the individual sheets have been cut or separated from the continuous form it is difficult to keep them in registration in order to make the letter folds properly. Furthermore, once cut or separated, the sheets are generally supported underneath which makes a Z-fold for the sheets problematic. By way of explanation, a Z-fold results when one marginal portion of the sheet is folded over the medial portion of the sheet and the other marginal portion of the sheet is folded under the medial portion of the sheet. A Z-fold has an advantage in mass produced letters in that the address at the head of the letter may be on the outside of the letter so that it may appear under a window in an envelope into which the letter is stuffed.

A second method of forming folded letters from the aforenoted paper web involves tractor feeding the web and then buckle folding the leading portion of the web subsequent to which the leading portion is severed from the web resulting in a folded letter sheet. One drawback with this approach is that it cannot be used where inserts have been adhered to the web ahead of the buckle folding station if such inserts are of significant thickness. Thus, for example, this method cannot be used where standard thickness credit cards (which are about 30 thousandth's of an inch in thickness) are attached to each sheet in the continuous form since the continuous form will then jam in the buckle folding rollers.

While not known to be used in the mass production of letter sheets, it is known to progressively fold webs along their length with edge guides which progressively urge a marginal portion of the web towards the center of the web. If this method were employed in the folding of the aforenoted paper web of computer paper (which typically has a width of about 9½ inches), it would require about an eight-foot run to complete a fold of a marginal portion of the web over the medial portion of the web without ripping the paper or causing it to separate at any transverse perforations. Space is generally extremely limited in mail rooms. This method would, therefore, be unsuitable in many mass mailing applications due to the large area that would be taken up by such machinery.

Accordingly, there remains a need for a method and apparatus for forming letter sheets more suitable for use in the mass production of letters.

SUMMARY OF THE INVENTION

Accordingly to the present invention, there is provided a method for forming folded letter sheets from a paper web over a short distance, comprising the following steps: feeding a paper web; at regularly spaced intervals representative of the width of a desired letter sheet, forming opposed pairs of transverse cuts in marginal portions of said web to separate all but a middle portion of said web provided such transverse cuts have not previously been formed in said web, each said transverse cut having a length at least about as great as the width of said middle portion of said web represented by the distance between the inner ends of opposed transverse cuts; folding the marginal portions of said web over said middle portion of said web and the other of said marginal portions of said web under said middle portion of said web so that the middle portion of said web is at least substantially covered by said marginal portions, said folding occurring over a short distance of no more than twice the distance between adjacent pairs of transverse cuts, said transverse cuts facilitating the folding over a said short distance; feeding the folded web; separating the middle portion of said web at said transverse cuts to form folded letter sheets.

In another aspect, there is provided an apparatus for forming folded letter sheets from a paper web: a first paper web feeder for feeding a paper web in a downstream direction; a paper web folder downstream of said first paper web feeder for folding marginal portions of said web about a middle portion of said web, said paper web folder comprising a medial portion for supporting said middle portion of said web and two ploughs, one progressively overlying said middle portion of said web in said downstream direction and the other of said two ploughs progressively underlying said middle portion of said web in said downstream direction whereby said paper web folder folds said web in a Z-fold; a second paper web feeder for feeding the folded web; synchronising means to synchronise said second paper web feeder with said first paper web feeder; a web separator for separating said folded web to form folded letter sheets. A transverse cut former between the first paper web feeder and the paper web folder separates all but the middle portion of the web along transverse cut lines at regularly spaced intervals representative of the width of a desired letter sheet. The transverse cut former forms transverse cuts in said web such that each transverse cut has a length at least about as great as the width of said middle portion of said web represented by the distance between the inner ends of opposed transverse cuts, and wherein said ploughs of said paper web folder have a length which is one and a half to two times the interval between the transverse cut lines formed by said transverse cut former in a paper web, said ploughs configured such that said marginal portions of said web substantially cover said middle portion of said web at the downstream end of said ploughs whereby the marginal portions of the web are folded over the middle portion of the web over a short distance.

BRIEF DESCRIPTION OF THE DRAWINGS

In the figures which disclose example embodiments of the invention.

DESCRIPTION OF THE PREFERRED EMBODIMENTS

Figures 1, 1A:
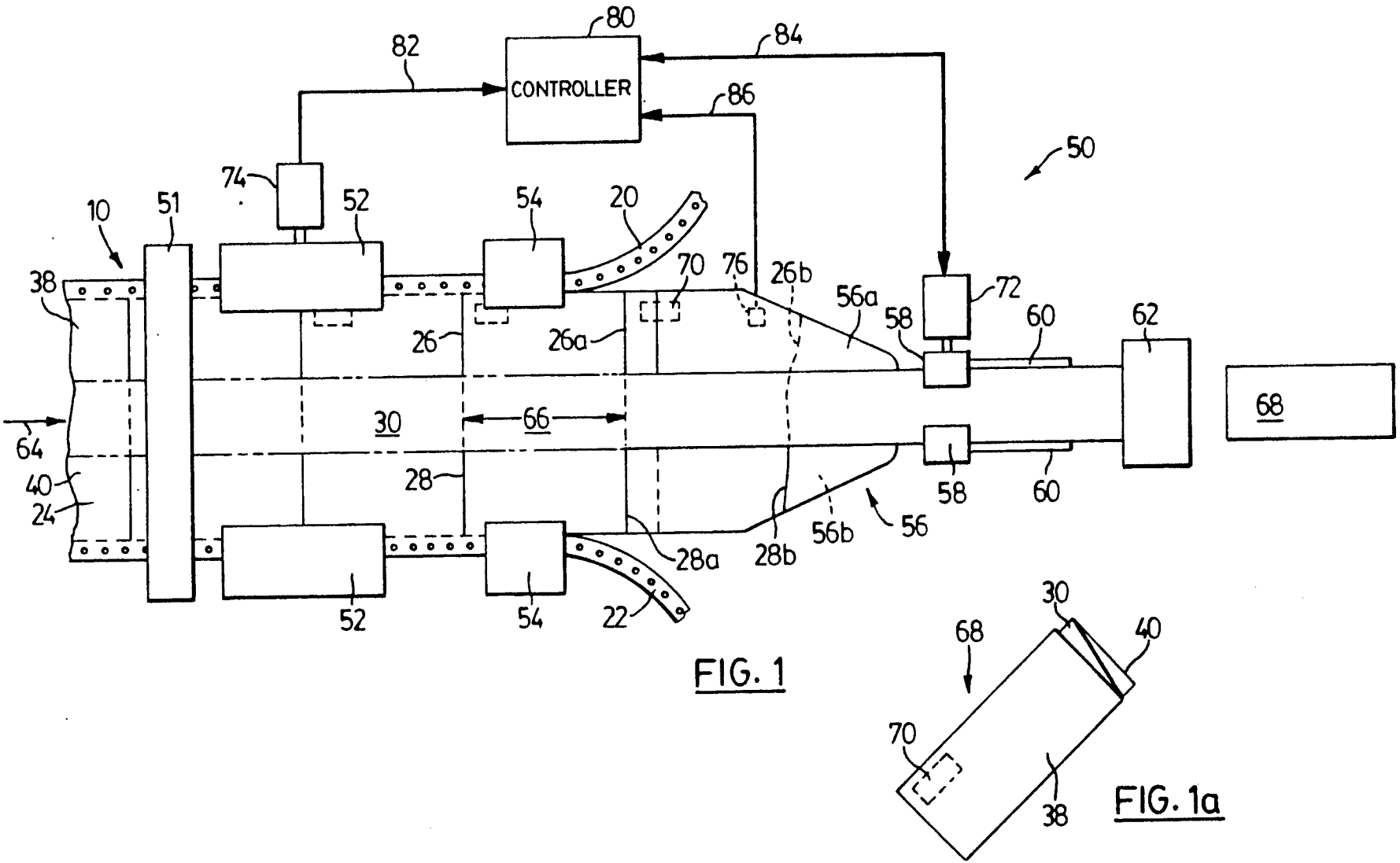
FIG. 1 is a plan view of a letter forming machine made in accordance with this invention.
FIG. 1*a* is a bottom perspective view of a folded letter sheet output from the machine of FIG. 1.

Turning to FIG. 1, machine 50 operates to move a web 10 in a downstream direction 64 and comprises, in consecutive downstream order: a printing station 51, tractor feeders 52, edge portion separators 54, Z-folder 56 comprising folding ploughs 56*a*, 56*b*, pinch rollers 58 with associated edge guides 60, and bursting station 62.

Figure 2:
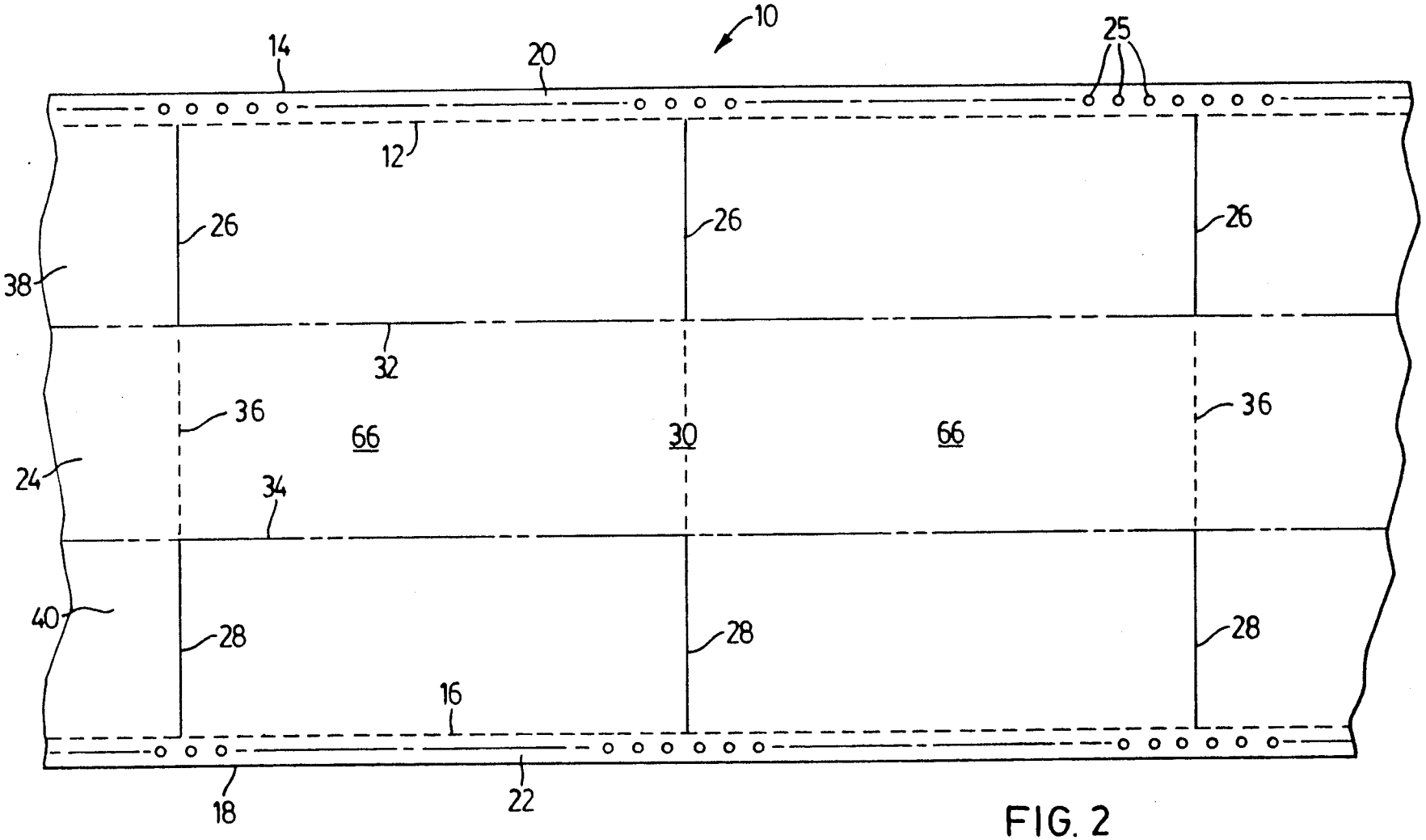
FIG. 2 is a plan view of a paper web used with the machine of FIG. 1.

The web 10 with which the machine 50 is adapted for use is illustrated in FIG. 2. Referring to FIG. 2, the paper web 10 has a marginal longitudinal line of perforation 12 proximate one side 14 of the web and a second marginal longitudinal line of perforation 16 proximate the other side 18 of the web. These longitudinal lines of perforation delimit edge portions 20 and 22. The edge portions 20 and 22 each have longitudinal lines of pin holes 25 for tractor feeding of the web.

A continuous form portion 24 extends between the edge portions. The continuous form portion 24 of the web has opposed pairs of marginal transverse cuts 26, 28. Cuts 26 extend from the longitudinal line of perforation 12 and cuts 28 extend from the longitudinal line of perforation 16. The opposed pairs of transverse cuts leave a middle web portion 30 which is uncut but which has a line of perforation 36 extending thereacross joining each opposed pair 26, 28 of transverse cuts. The transverse cuts 26 extending from line of perforation 12 are of uniform length. Similarly, the cuts 28 extending from line of perforation 16 are of uniform length. The pairs 26, 28 of cuts are spaced uniformly along the length of the web 10. Furthermore, each cut extends approximately one-third of the width of the continuous form portion 24 of the web.

A longitudinal scored line 32 extends along the inside end of cuts 26 and, similarly, a longitudinal scored line 34 extends along the inside end of cuts 28. These scored lines form continuous form marginal portions 38 and 40 on either side of the middle portion 30.

Each segment of the continuous form portion 24 between adjacent pairs of opposed transverse cuts is a sheet precursor 66 with the short (i.e. width) dimension of the sheet precursor being in line with the direction of travel of the web.

Returning to FIG. 1, the ploughs 56*a* and 56*b* of Z-folder 56 have a length which is one and one half to two times that of the longitudinal spacing between adjacent pairs of opposed transverse cuts 26, 28 of web 10. Furthermore, the ploughs may commence at the output of separators 54 or, as shown, may be spaced downstream from the separators 54.

The control system for the machine 50 comprises drive/tachometer 72 for driving pinch rollers 58 and for providing an indication of the speed of the pinch rollers, drive/tachometer 74 for driving tractor feed 52 and for providing an indication of the speed of the tractor feed, sensor 76 for sensing cuts 26, and controller 80 for receiving the output of the two encoders and the sensor on paths 82, 84, and 86 and for providing a drive control signal to the drive/tachometer 72 on path 84.

In operation of the machine 50, printing station 51 may print text on each sheet precursor 66 including an address 70 in the top left corner of each sheet precursor, which is therefore in the marginal portion 38 of the continuous form portion of the web. Tractor feeders 52 feed web 10 in the downstream direction 64 and pinch rollers 58 provide for the feeding of the web downstream of the tractor feeders 52. At edge portion separators 54, the edge portions 20 and 22 are separated off and discarded leaving the continuous form portion 24 of the web. Downstream of separators 54, the continuous form 24 is pulled through folding ploughs 56*a*, 56*b*. Plough 56*a* acts on the marginal portion 38 of the continuous form 24 to fold it under the medial portion 30 of the continuous form and plough 56*b* acts to fold marginal portion 40 of the continuous form 24 over the medial portion of the continuous form so that the continuous form has a Z-fold.

Since ploughs 56*a*, 56*b* have a length which is one and a half to two times the distance between adjacent pairs of transverse cut lines, the Z-fold is formed without risk of tearing, kinking or otherwise mutilating the web. But the distance between adjacent pairs of transverse cuts simply defines the width of a sheet precursor 66. Accordingly, the length of the machine 50 which is required to fold a sheet precursor 66 is about twice the width of a sheet precursor. Since the width of a sheet precursor is typically 8½ inches, the length required to fold is about 17 inches.

An indication of the speed with which tractor feed 52 moves web 10 inputs controller 80 on path 82. This signal is used as a control signal for the drive 72 of pinch rollers 58 so that the pinch rollers feed the web at the same speed as the tractor feed. Accordingly, the continuous form may be kept taut at ploughs 56*a* and 56*b* by tractor feeders 52 and pinch rollers 58.

The folded continuous form 24 downstream of the ploughs 56*a*, 56*b* passes through the nip of pinch rollers 58 and is then kept in registration by edge guides 60. Pinch rollers 58 apply a positive downstream feeding tension on the continuous form. Note that it is the uncut (but perforated) middle portion 30 of the web which allows the continuous form to be pulled by the pinch rollers 58. The folded continuous form then passes to burster 62 which bursts the middle portion 30 of the continuous form across the transverse line of perforation at each opposed pair of transverse cuts to thereby form sheets 68 from the sheet precursors 66. FIG. 1*a* illustrates a folded sheet 68 in bottom perspective view.

It will be apparent that the sheet 68 has been folded so that the printed address faces outwardly from the underneath of the sheet.

While it is intended that pinch rollers 58 move web 10 at the same speed as tractor feed 52, the speed at which the pinch rollers move the web may vary slightly from that of the tractor feed; this may be due to a small discrepancy in the diameter of the pinch rollers from that of their nominal diameter. Such a speed variation would be cumulative, resulting in the web becoming increasing tight until it breaks or loosening until the web misfeeds through machine 50. These problems are avoided as follows. Sensor 76 senses each transverse cut 26 as each such cut passes over the sensor. The signal from the sensor passes to the controller on path 86. Also, the speed of the pinch rollers 58 as measured by the tachometer portion of driver/tachometer 72 pass to the controller 80 on path 84. The controller is programmed with the nominal diameter of the pinch roller to which the tachometer is attached and with the dimension (width) of each sheet precursor in the downstream direction of travel of the web 10, which is a constant. Knowing the speed and nominal diameter of the pinch roller, the controller may determine the nominal distance travelled by a point on the circumference of the pinch roller between any two pulses from the sensor 76. But two consecutive signals from the sensor 76 indicate that one sheet precursor 66 has passed the sensor. Consequently, if this nominal distance is not equal to the known width of a sheet precursor, it indicates that the pinch rollers are not moving the web at an identical speed to that of the tractor feed. More particularly, if the nominal distance is less than the width of sheet precursor then the pinch rollers are moving too slowly and, conversely, if the nominal distance is greater than the width of a sheet precursor, then the pinch rollers are moving too quickly. The controller uses this feedback signal to modify the speed of the drive of drive/tachometer 72 in order to achieve synchronism between the tractor feed and the pinch rollers.

Because the machine 50 folds in the direction of movement of the web rather than transversely thereto, it will be apparent that the web may be folded even where thick inserts have been adhered to the middle portion 30 of the web 10. Furthermore, it will be noted that since the sheets 68 are burst only after folding, registration for folding is made simple since the web is held in registration by tractor feeders 52, pinch rollers 58 and edge guides 60.

Where a clean edge is required for letter sheets 68, burster 62 may be replaced with a double knife cutter which will cut the web on either side of each of the perforation lines 36.

Figure 3:
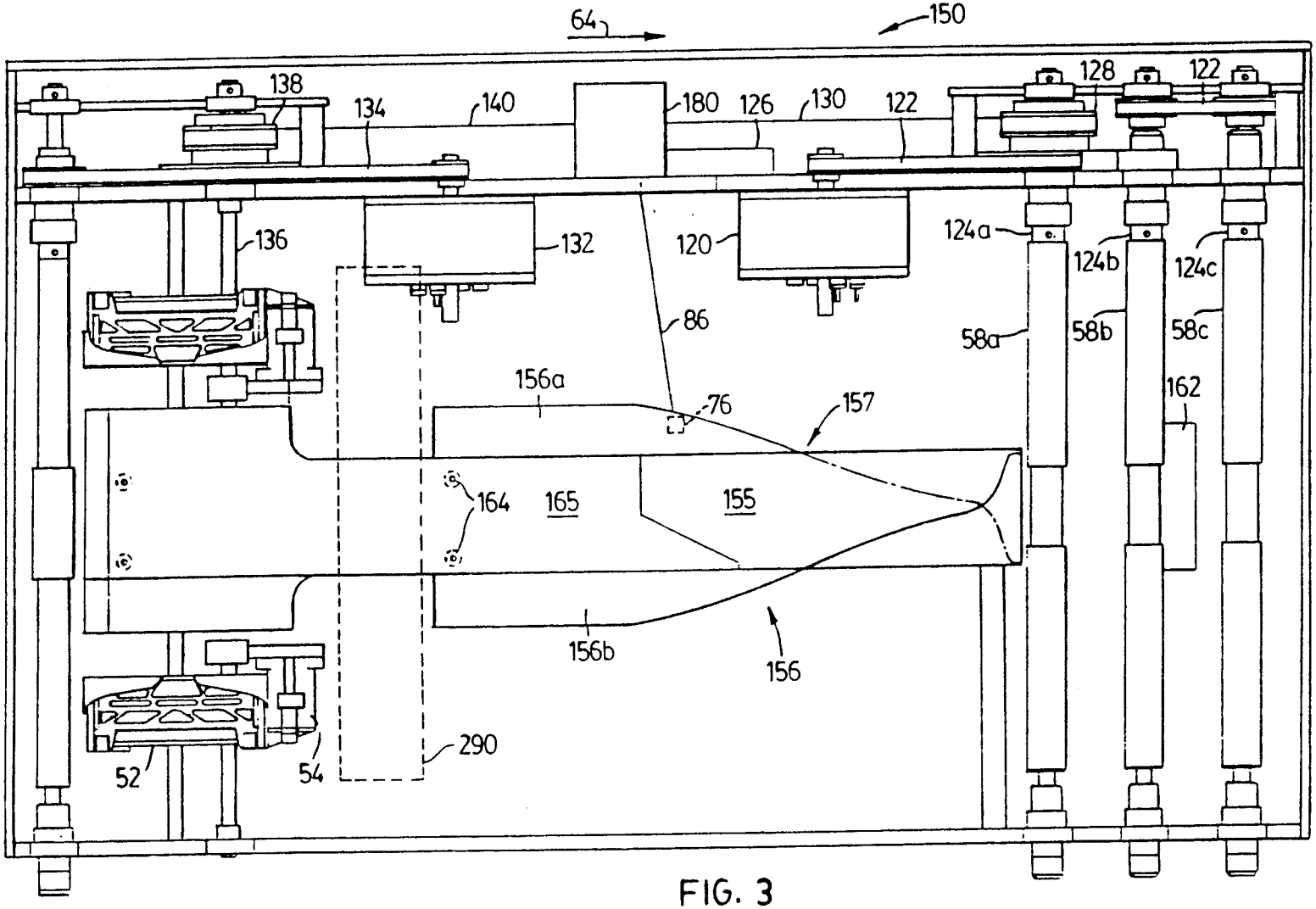
FIG. 3 is a plan view of a further embodiment of a letter forming machine made in accordance with this invention.
Figure 4:
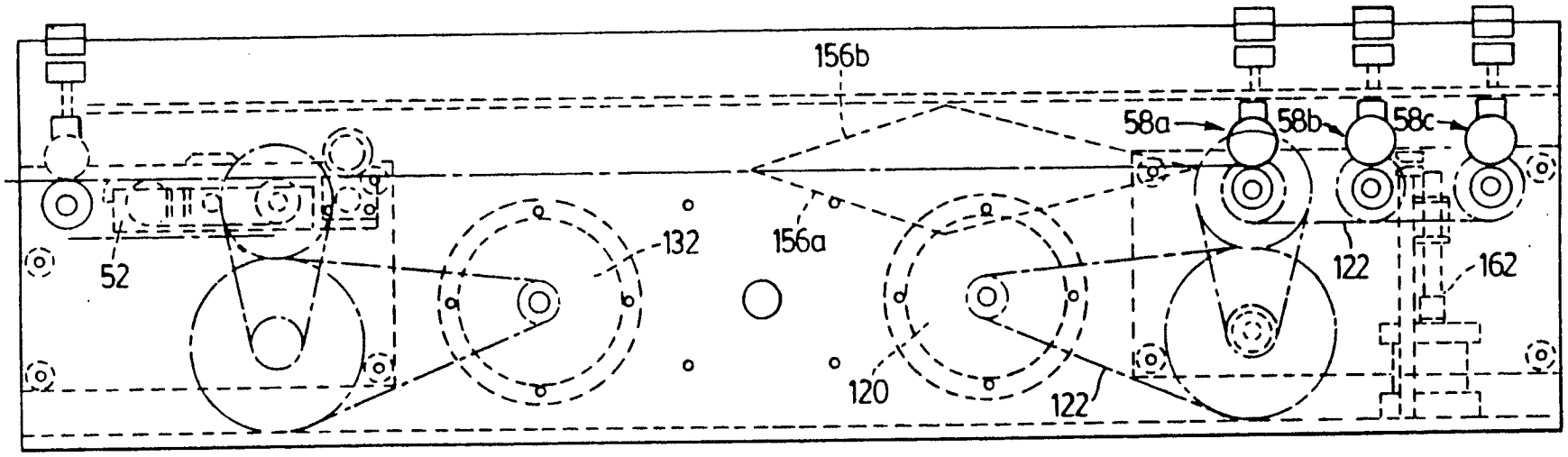
FIG. 4 is a side view of the letter forming machine of FIG. 3.
Figures 5, 6:
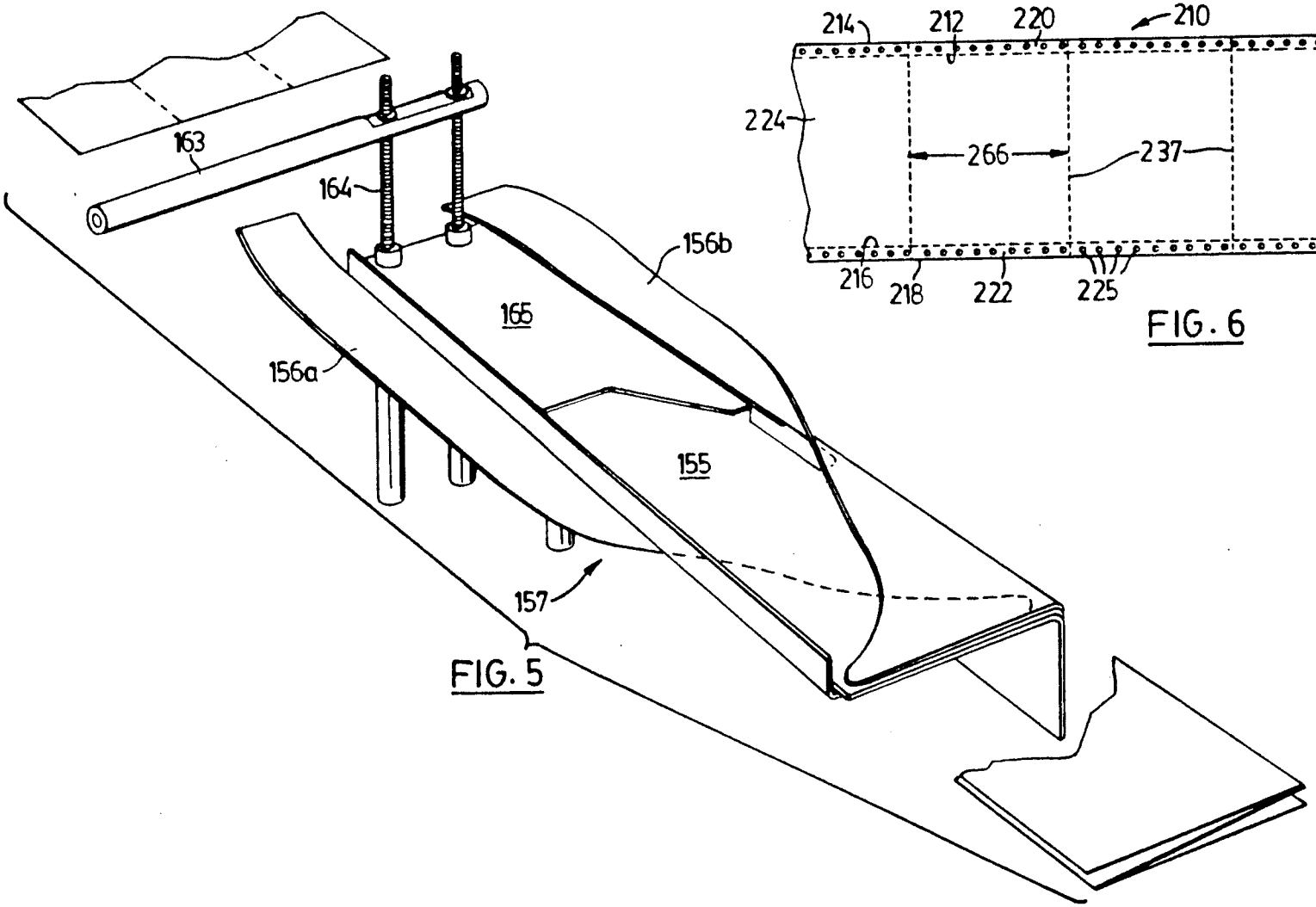
FIG. 5 is a perspective view of a portion of the machine of FIGS. 3 and 4.
FIG. 6 is a plan view of a paper web used with the machine of FIG. 3.
Figures 5, 6:
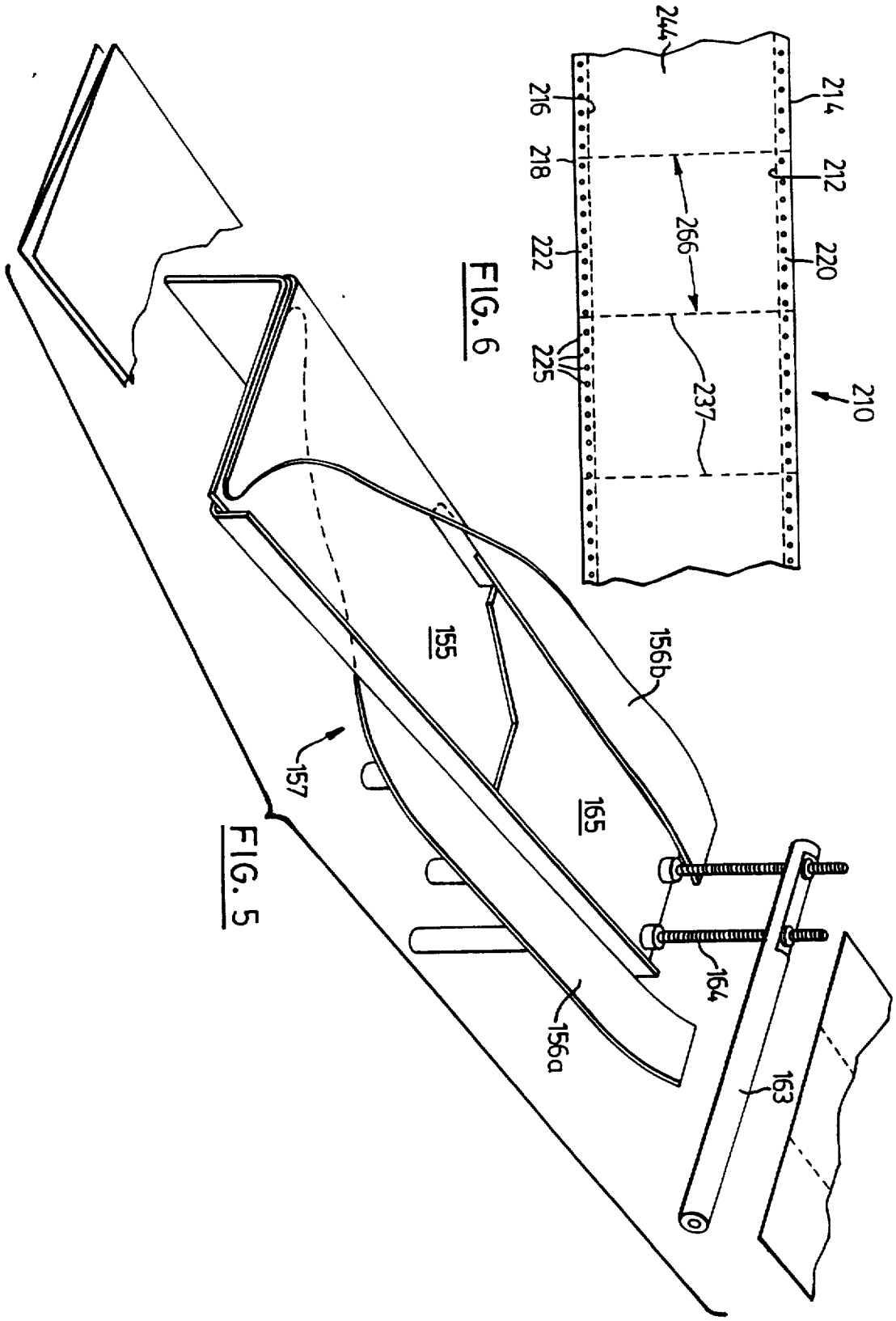

FIGS. 3 through 5 illustrate an alternate machine 150 for use in forming folded letter sheets from the web 10 of FIG. 2. Turning to FIGS. 3 through 5 wherein like parts have been given like reference numerals, machine 150 comprises, in consecutive downstream 64 order: tractor feed 52, separators 54 (which are illustrated as slitters), Z-folder 156, pinch roller sets 58*a*, 58*b*, double knife cutter 162, and pinch rollers 58*c*. The Z-folder (illustrated in perspective view in FIG. 5) comprises middle web portion guide 155 and ploughs 156*a*, 156*b*. Plough 156*a* is suspended by shaft 163, rods 164 and support 165 above the plane of the middle web portion guide upstream of cross-over point 157. Plough 156*a* folds to progressively underlie the middle web portion guide 155 downstream of the crossover point 157. The middle web portion guide 155 is formed integrally with plough 156*b* and plough 156*b* folds in the downstream direction to progressively overlie the middle web portion guide 155 beyond crossover point 157. The length of ploughs 156*a* and 156*b* over which they fold is one and a half to two times the longitudinal spacing between adjacent pairs of opposed transverse cuts 26, 28 of web 10 of FIG. 2. A drive 120 is connected by belts 122 to the drive shafts 124*a*, 124*b*, 124*c* of the pinch roller sets. A controller 180 supplies the control input to drive 120 on path 126. The output of rotary encoder 128 of shaft 124*a* inputs controller 180 on path 130. A drive 132 is connected by belts 134 to the drive shaft 136 of the tractor feed 52 and the separator 54. The output of a rotary encoder 138 on shaft 136 inputs the controller on path 140. Signals from a sensor 76 underlying plough 56*a* input the controller on path 86.

The operation of the machine of FIGS. 3 through 5 is similar to that of FIG. 1. More particularly, with reference to these figures as well as FIG. 2, tractor feeders 52 feed web 10 in the downstream direction 64 and pinch rollers 58 provide for the feeding of the web downstream of the tractor feeders 52. At edge portion separators 54, the edge portions 20 and 22 are separated off and discarded leaving the continuous form portion 24 of the web. Downstream of separators 54, the continuous form 24 is pulled through folding ploughs 56*a*, 56*b*. Plough 56*a* acts on the marginal portion 38 of the continuous form 24 to fold it under the medial portion 30 of the continuous form and plough 56*b* acts to fold marginal portion 40 of the continuous form 24 over the medial portion of the continuous form so that the continuous form has a Z-fold. At the downstream end of the Z-folder 156, a portion of the web overlies the middle web portion support 155 and a portion underlies the middle web portion support; the folded web is taken up by the pinch rollers 58*a*. The length of the Z-folder ensures the operation of the machine does not damage the web 10 and also minimizes the length of the machine 150.

An indication of the speed with which tractor feed 52 moves web 10 inputs controller 180 on path 140. This signal is used as a control signal for the drive 120 of pinch rollers 58*a*, 58*b*, 58*c* so that the pinch rollers feed the web nominally at the same speed as the tractor feed. Any discrepancy in the speed of the pinch rollers is quantified by the controller 180 through the encoder signal on path 130 and the sensor signal on path 86. The discrepancy may then be nulled by adjusting the control signal for drive 120 on path 126. Accordingly, the continuous form may be kept taut at ploughs 56*a* and 56*b* by tractor feeders 52 and pinch rollers 58*a*, 58*b*. Note that it is the uncut (but perforated) middle portion 30 of the web which allows the continuous form to be pulled by the pinch rollers.

The folded continuous form then passes from pinch rollers 58*b* to cutter 162 which cuts the middle portion 30 of the continuous form on either side of the transverse line of perforation at each opposed pair of transverse cuts to thereby form sheets 68 from the sheet precursors 66. Of course, cutter 162 could be replaced with a rotary burster, if desired.

In a further embodiment of a machine made in accordance with this invention, a transverse cut forming station 290, shown in phantom in FIG. 3, is positioned between separators 54 and Z-folder 156. The transverse cut forming station is either a rotary burster or a rotary cutter or both a rotary cutter and a perforator, depending upon the paper web used with machine 150. Machine 150 may be input with the paper web 210 illustrated in FIG. 6 which comprises a marginal longitudinal line of perforation 212 proximate one side 214 of the web and a second marginal longitudinal line of perforation 216 proximate the other side 218 of the web. These longitudinal lines of perforation delimit edge portions 220 and 222. The edge portions 220 and 222 each have longitudinal lines of pin holes 225 for tractor feeding of the web. A continuous form portion 224 extends between the edge portions. The continuous form portion 224 of the web has transverse lines of perforation 237 spaced uniformly along the length of the web 210. Each segment of the continuous form portion 224 between adjacent lines of perforation 237 is a sheet precursor 266 with the short (i.e. width) dimension of the sheet precursor being in line with the length dimension of the web.

For use with web 210, transverse cut forming station is a burster which bursts marginal portions of each line of perforation 237 so as to form transverse cuts which extend from the marginal longitudinal line 212 and cuts which extend from the marginal longitudinal line 216 such that the cuts are of uniform length and opposed pairs of transverse cuts leave a middle web portion which is uncut. Thus downstream of station 290, the web is identical to the web 10 of FIG. 2 after edge portions 20 and 22 have been removed (except that the longitudinal score lines 32, 34 are not present) and processing of the web 210 in the machine 150 downstream of station 290 is identical to the processing of web 10 by machine 150 downstream of separators 54.

In this regard, it is noted that the ploughs 256*a* and 256*b* of the Z-folder have a length which is one and one half to two times that of the longitudinal spacing between adjacent perforation lines 237 of web 210.

Machine 150 could be modified for use with a paper web which is simply a continuous strip of paper by employing pinch roller feeds in place of tractor feeds, eliminating separators 54 and utilising a rotary cutter in place of a burster at station 290 to cut opposed pairs of transverse cuts in the marginal portions of the web. Alternatively, station 290 could be a rotary cutter and perforator in which case double knife cutter 162 would be replaced with a rotary burster. The rotary cutter and perforator at station 290 would cut opposed pairs of transverse cuts in the marginal portions of the web and perforate the middle portion of the web and the rotary burster would burst the perforated middle portion of the folded web to form the folded letter sheets.

Other modifications will be apparent to those skilled in the art and, accordingly, the invention is defined in the claims.

What is claimed is:

1. A method for forming folded letter sheets from a paper web over a short distance, comprising the following steps:

feeding a paper web;

at regularly spaced intervals representative of the width of a desired letter sheet, forming opposed pairs of transverse cuts in marginal portions of said web to separate all but a middle portion of said web provided such transverse cuts have not previously been formed in such web, each said transverse cut having a length at least about as great as the width of said middle portion of said web represented by the distance between the inner ends of opposed transverse cuts;

folding one of said marginal portions of said web over said middle portion of said web and the other of said marginal portions of said web under said middle portion of said web so that the middle portion of said web is at least substantially covered by said marginal portions, said folding occurring over a short distance of no more than twice the distance between adjacent pairs of transverse cuts, said transverse cuts facilitating the folding over said short distance;

feeding the folded web;

separating the middle portion of said web at said transverse cuts to form folded letter sheets.

2. The method of claim 1 wherein the step of feeding the folded web is synchronised with the prior step of feeding the paper web.

3. The method of claim 2 including the step of removing any drivable edge portions of said web prior to said step of forming opposed pairs of transverse cuts in marginal portions of said web to separate all but a middle portion of said web.

4. The method of claim 1 wherein said step of forming opposed pairs of transverse cuts comprises forming transverse cuts such that those extending from a given side of said web are of uniform length.

5. Apparatus for forming folded letter sheets from a paper web:

a first paper web feeder for feeding a paper web in a downstream direction;

a paper web folder downstream of said first paper web feeder for folding marginal portions of said web about a middle portion of said web, said paper web folder comprising a medial portion for supporting said middle portion of said web and two ploughs, one progressively overlying said middle portion of said web in said downstream direction and the other of said two ploughs progressively underlying said middle portion of said web in said downstream direction whereby said paper web folder folds said web in a Z-fold;

a second paper web feeder for feeding the folded web;

synchronising means to synchronise said second paper web feeder with said first paper web feeder;

a web separator for separating said folded web to form folded letter sheets; a transverse cut former between said first paper web feeder and said paper web folder for separating all but a middle portion of said web along transverse cut lines at regularly spaced intervals representative of the width of a desired letter sheet wherein said transverse cut former forms transverse cuts in said web such that each transverse cut has a length at least about as great as the width of said middle portion of said web represented by the distance between the inner ends of opposed transverse cuts, and wherein said ploughs of said paper web folder have a length which is one and a half to two times the interval between the transverse cut lines formed by said transverse cut former in a paper web, said ploughs configured such that said marginal portions of said web substantially cover said middle portion of said web at the downstream end of said ploughs whereby the marginal portions of the web are folded over the middle portion of the web over a short distance.

6. The apparatus of claim 5 including a drivable edge portion separator between said first paper web feeder and said transverse cut former for removing drivable edge portions of said web, said drivable edge portion separator being spaced upstream of said paper web folder a distance at least equal to the interval between the transverse cuts in said paper web formed by said transverse cut former whereby said web is free to fold under the influence of said paper web folder without binding or tearing at said slitter.

7. Apparatus for forming folded letter sheets from a paper web of the type having marginal longitudinal lines of perforations forming edge portions having pin holes and transverse perforation lines at regular intervals extending across at least a middle portion of said web, said apparatus comprising the following:

a tractor feed for feeding a paper web;

a slitter for removing the edge portions of said web having tractor feed pin holes;

a transverse cut former downstream of said slitter for separating all but said middle portion of said web along opposed transverse cut lines in line with said transverse perforation lines with the transverse cuts extending from any given side of said web being of uniform length and each transverse cut having a length at least about as great as the width of said middle portion of said web;

a paper web folder downstream of said transverse cut former for folding marginal portions of said web about said middle portion of said web having a medial portion for supporting said middle portion of said web and two ploughs, one progressively overlying said middle portion of said web in said downstream direction and the other progressively underlying said middle portion of said web in said downstream direction whereby said paper web folder folds said web in a Z-fold;

two sets of pinch rollers for feeding the folded paper web;

synchronising means to synchronise said two sets of pinch rollers with said tractor feed;

a separator between said two sets of pinch rollers for separating said folded web at transverse perforation lines which extend across said middle portion of said web.

8. The apparatus of claim 7 wherein said paper web folder is spaced downstream of said slitter a distance at least equal to the interval between the transverse perforations in said paper web whereby said web is free to fold under the influence of said paper web folder without binding or tearing at said slitter.

9. The apparatus of claim 7 wherein said synchronising means comprises a sensor for sensing the web at said transverse perforation lines and means for sensing the speed of a pinch roller of said two sets of pinch rollers and for comparing the number of revolutions of such pinch roller between adjacent of said transverse perforation lines and for adjusting the speed of said two sets of pinch rollers where necessary.

10. The apparatus of claim 9 wherein said transverse cut former forms transverse cuts in said web such that each transverse cut has a length at least about as great as the width of said middle portion of said web represented by the distance between the inner ends of opposed transverse cuts, and wherein said ploughs of said paper web folder have a length which is one and a half to two times the interval between the transverse perforations in said paper web, said ploughs configured such that said marginal portions of said web substantially cover said middle portion of said web at the downstream end of said ploughs whereby the marginal portions of the web are folded over the middle portion of the web over a short distance.

* * * * *

UNITED STATES PATENT AND TRADEMARK OFFICE

CERTIFICATE OF CORRECTION

PATENT NO. : 5,298,009

DATED : March 29, 1994

INVENTOR(S) : John A. Long

It is certified that error appears in the above-identified patent and that said Letters Patent is hereby corrected as shown below:

column 8, line 24, after "those" insert --cuts--.

Signed and Sealed this

Sixth Day of September, 1994

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,298,009

DATED : March 29, 1994

INVENTOR(S) : John A. Long

It is certified that error appears in the above-indentified patent and that said Letters Patent is hereby corrected as shown below:

Delete drawing sheet 5 of 5, and substitute therefor the drawing sheet, consisting of FIGS. 5-6, as shown on the attached pages.

Signed and Sealed this

Twentieth Day of December, 1994

*Attest:*

Bruce Lehman

BRUCE LEHMAN

*Attesting Officer*

*Commissioner of Patents and Trademarks*